United States Patent [19]

Sato

[11] Patent Number: 4,722,156

[45] Date of Patent: Feb. 2, 1988

[54] CONCRETE FILLED STEEL TUBE COLUMN AND METHOD OF CONSTRUCTING SAME

[75] Inventor: Takanori Sato, Tokyo, Japan

[73] Assignee: Shimizu Construction Co., Ltd., Tokyo, Japan

[21] Appl. No.: 835,954

[22] Filed: Mar. 4, 1986

[30] Foreign Application Priority Data

| | | | |
|---|---|---|---|
| Mar. 5, 1985 | [JP] | Japan | 60-42979 |
| Mar. 7, 1985 | [JP] | Japan | 60-45285 |
| Apr. 23, 1985 | [JP] | Japan | 60-87172 |
| Apr. 23, 1985 | [JP] | Japan | 60-87173 |
| Jul. 3, 1985 | [JP] | Japan | 60-146386 |
| Jul. 16, 1985 | [JP] | Japan | 60-156365 |
| Jul. 16, 1985 | [JP] | Japan | 60-156366 |

[51] Int. Cl.[4] ..... E04C 3/34

[52] U.S. Cl. ..... 52/98; 52/724; 52/725

[58] Field of Search ..... 52/236.9, 263, 722, 52/724, 725, 727, 733, DIG. 5, 1, 98, 670

[56] References Cited

U.S. PATENT DOCUMENTS

| | | | |
|---|---|---|---|
| 1,571,092 | 1/1926 | Lally | 52/725 |
| 2,176,007 | 10/1939 | Heanue | 52/725 |
| 3,058,264 | 10/1962 | Varlonga | 52/236.9 |
| 3,828,504 | 8/1974 | Egerborg | 52/722 |
| 4,016,701 | 4/1977 | Beynon | 52/573 |
| 4,281,487 | 8/1981 | Koller | 52/725 |
| 4,407,106 | 10/1983 | Beck | 52/725 |

FOREIGN PATENT DOCUMENTS

| | | | |
|---|---|---|---|
| 2723534 | 12/1978 | Fed. Rep. of Germany | 52/725 |

*Primary Examiner*—Carl D. Friedman

*Attorney, Agent, or Firm*—Scully, Scott, Murphy & Presser

[57] ABSTRACT

An concrete filled steel tube column and method of constructing same. The concrete filled steel tube column includes a steel tube having an inner face; a concrete core disposed within the steel tube; and a separating layer interposed between the inner face of the steel tube and the concrete core for separating the concrete core from the inner face of the steel tube so that the steel tube may not be bonded to the concrete core. After the separating layer is formed on the inner face of the steel tube, the concrete is charged into the steel tube to form a concrete core.

22 Claims, 21 Drawing Figures

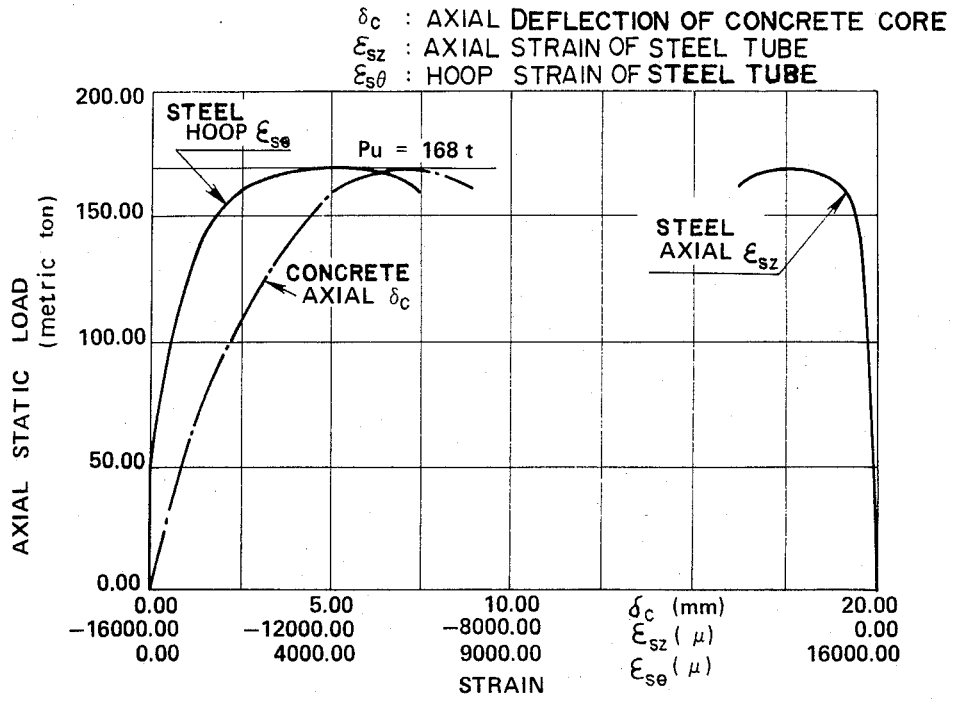
FIG.18 EXAMPLE
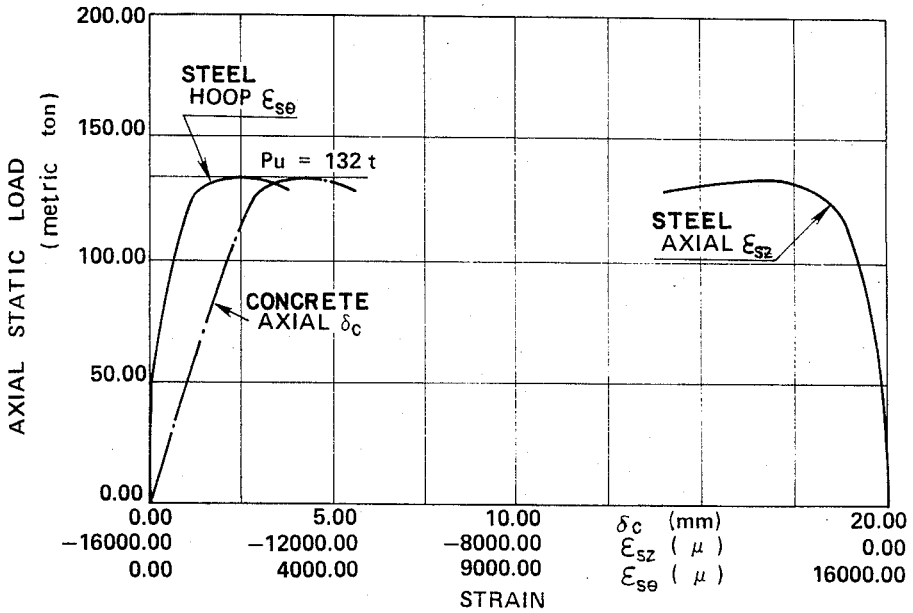
FIG.19 COMPARATIVE TEST

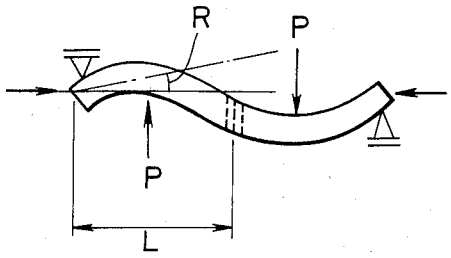
FIG.20
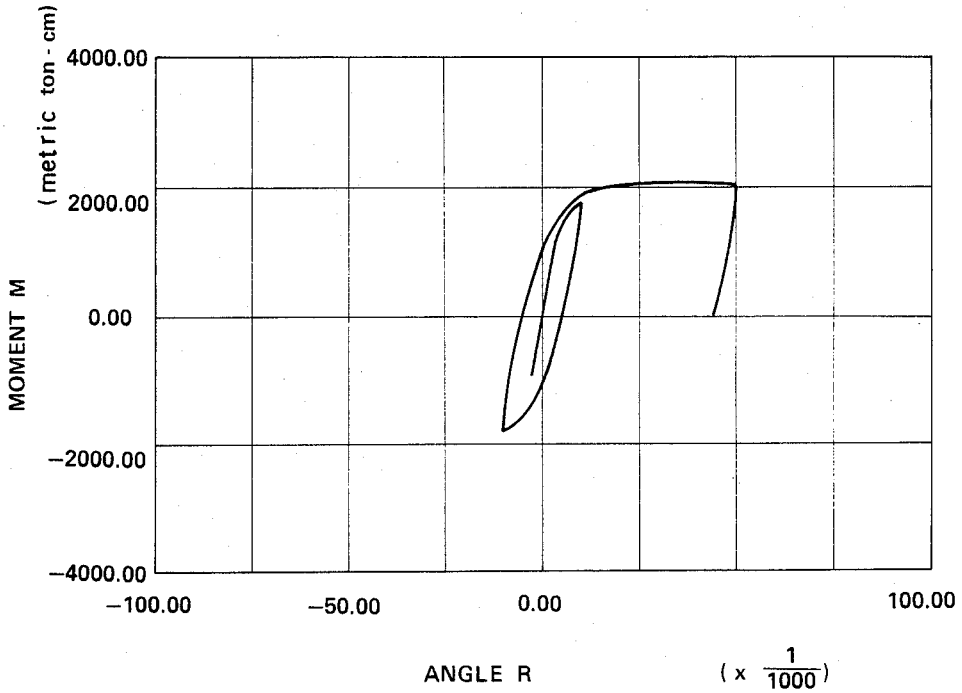
FIG.21 EXAMPLE 2

CONCRETE FILLED STEEL TUBE COLUMN AND METHOD OF CONSTRUCTING SAME

BACKGROUND OF THE INVENTION

The present invention relates to a concrete filled steel tube column and method of constructing same, the concrete filled steel tube column being for use in, for example, columns and piles of building structures.

Heretofore, this kind of concrete filled steel tube column is constructed by erecting a steel tube which also serves as a formwork other than a casing and then by filling the steel tube with a concrete to form a concrete core. The steel tube and the concrete core show integral behavior when an axial compression is applied to the steel encased concrete column since they are bonded to each other. When the concrete column is subjected to an axial compression beyond a predetermined compression strength, excess strains develop in the steel tube and the concrete core, resulting in that local buckling is produced in the steel tube or in that the steel tube reaches a yield area under Mieses's yield conditions. Thus, the steel tube does not provide the concrete core with sufficient confinement, which causes the concrete core to reach a downward directed area of the stress-strain curve at a load applied considerably lower than a predetermined load. For this reason, it cannot be expected to efficiently enhance the concrete core in compression strength by the lateral confinement of the steel tube and hence a relatively large cross-sectional area must be given to the concrete filled steel tube column to provide sufficient strength to it.

SUMMARY OF THE INVENTION

Accordingly, it is an object of the present invention to provide a concrete filled steel tube column and method of constructing same which efficiently enhance the concrete core in compression strength to thereby enable a considerable reduction in the cross-section thereof as compared to the prior art column.

With this and other objects in view one aspect of the present invention is directed to a concrete filled steel tube column, including a steel tube having an inner face; a concrete core disposed within the steel tube; and a separating layer interposed between the inner face of the steel tube and the concrete core for separating the concrete core from the inner face of the steel tube so that the steel tube is unbonded to the concrete core.

The other aspect of the present invention is directed to a method of constructing a concrete filled steel tube column, in which: a steel tube is prepared, then a separating layer is formed on an inner face of the steel tube so that the inner face of the steel tube is not bonded to a concrete; and the concrete is charged into the steel tube with the separating layer to form a concrete core within the steel tube, whereby the steel tube is unbonded to the concrete core.

BRIEF DESCRIPTION OF THE DRAWINGS

In the drawings:

FIG. 18 is a graph showing load-strain characteristic of a concrete filled steel tube column according to the present invention;

FIG. 19 is a graph showing load-strain characteristic of a prior art concrete filled steel tube column;

FIG. 20 is a diagrammatical view of a test piece according to the present invention; and FIG. 21 is a graph illustrating a moment hysteresis loop of the test piece in FIG. 20.

DETAILED DESCRIPTION OF THE PREFERRED EMBODIMENTS

Figure 1:
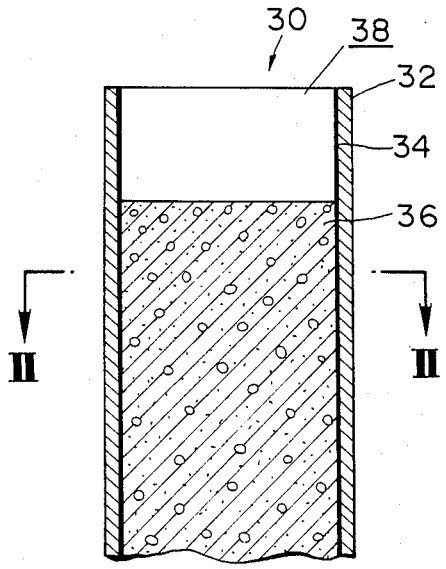
FIG. 1 is a partial view illustrating an axial cross-section of a concrete filled steel tube column constructed according to the present invention.
Figure 2:
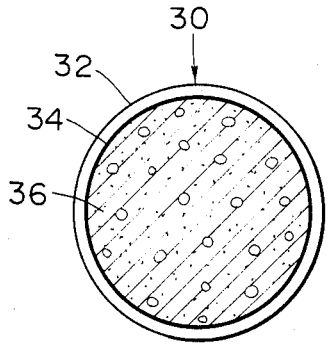
FIG. 2 is a view taken along the line II—II in FIG. 1.

In the drawings, like reference characters designate corresponding parts throughout views, and descriptions of the corresponding parts are omitted after once given. Referring now to FIGS. 1 and 2, reference numeral 30 designates an unbonded, concrete filled steel tube column according to the present invention in which a separating material, asphalt in this embodiment, is applied over the inner face of the steel tube 32 to form a separating layer 34 and then a concrete is filled into it to form a concrete core 36. In the present invention, steel tubes used in the conventional concrete filled steel tube column or steel encased concrete column may be used as the steel tube 32. The separating layer 34 serves to separate the steel tube 32 from the concrete core 36 so that the concrete core 36 is unbonded to the steel tube 32. The separating material used in the present invention may include, for example, a grease, paraffin wax, synthetic resin, paper and a like material other than asphalt. The thickness of the separating layer 34 is such that it provides a viscous slip to the concrete core 36. In asphalt, the thickness of the separating layer 34 is about 20–100$\mu$. According to the invention, the concrete may include, for example, an ordinary concrete, lightweight concrete, fiber concrete, etc. The concrete filled steel tube column 30 has a cylindrical unoccupied space 38 defined at its one end portion. The space 38 is to be filled with a grout for grouting in jointing the tube column 30 to another steel tubes 32.

The steel tube 32 and the concrete core 36 of the concrete filled steel tube column 30 are in an unbonded state and hence they are axially movable relative to each other. This means that when the concrete core 36 is subjected to an axial compression, little axial strain is produced in the steel tube 32 and a hoop tension develops in the steel tube 32 by providing a lateral confinement to the concrete core 36. Thus, the column 30 produces a synergistic result by exercising characteristics of its components. That is, the column 30 sustains an axial load with the concrete core 36, which is relatively strong against compression, and holds against a hoop tension by the steel tube 32 which is relatively strong against tension. The column 30 insures considerably high strength as compared to the conventional bonded, concrete-filled steel tube columns and thus it is possible for the column 30 to largely reduce its cross-sectional area for a given strength.

Figure 3:
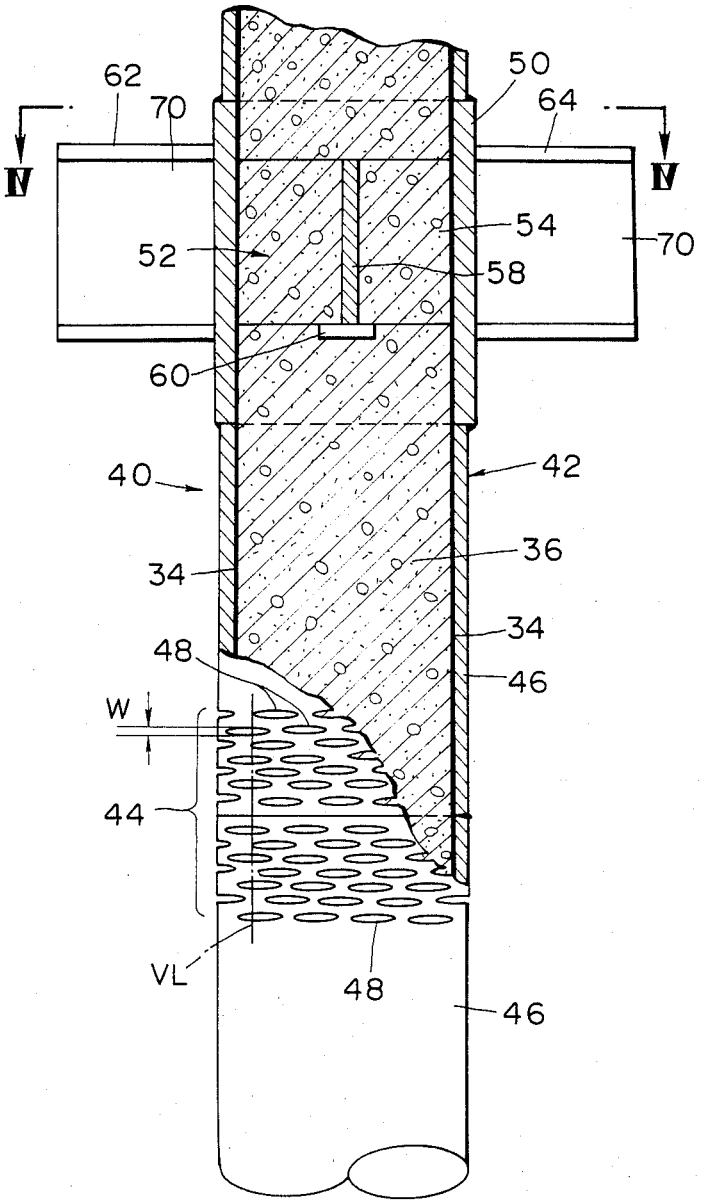
FIG. 3 is a front view, partly in section, of another embodiment of the present invention.
Figure 4:
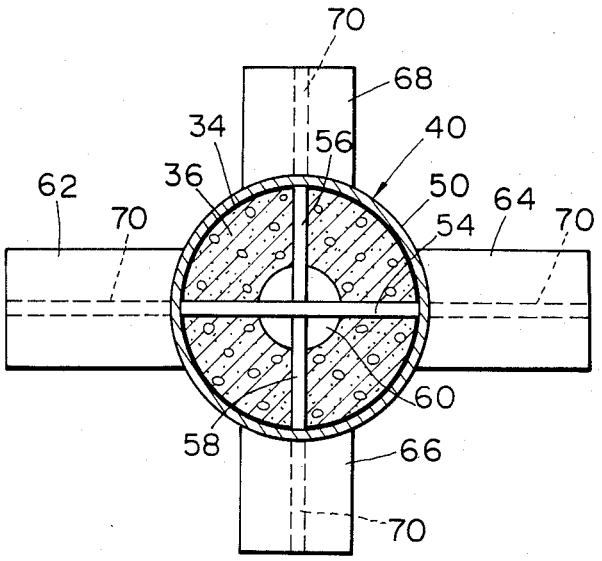
FIG. 4 is a view taken along the line IV—IV in FIG. 3.

FIGS. 3 to 4 illustrate a modified form of the concrete filled steel tube column in FIGS. 1 and 2. In this modification, the steel tube 42 consists of a pair of tube pieces 46 and 46 concentrically welded at one end thereof and each tube piece 46 is provided at its one end with seven circumferential rows of slits or through slots 48 in a zigzag manner. Thus, the steel tube 42 is provided at its intermediate portion, i.e., inflection point of moment, with a slit portion 44 having 14 rows of slits 48. The sum of vertical width W of vertically aligned slits 48 of the slit portion 44 (e.g., the slits 48 on the phantom line VL in FIG. 3) is preferably around a maximum axial strain of the steel tube 42 to be caused by overturning moment of the building. The shape of the slits 48 may be a rectangle, ellipse and like configurations. The vertical length of the slit portion 44 is substantially equal to the diameter of the column 40. The steel tube 42 has a relatively short joint steel tube 50 concentrically welded at its end. The joint tube 50 has a load transfer assembly 52 welded to its inner face. The load transfer assembly 52 includes a web 54 and webs 56 and 58 perpendicularly welded to the web 54 to form a cross shape as shown in FIG. 4. The load transfer assembly 52 has a bearing disc member 60 welded to its lower edges to be concentric with the joint tube 50. Also, the joint tube 50 is coated over its inner face with the separating layer 34 and is charged with the concrete. Another steel tube is concentrically welded to the upper edge of the joint tube 50. The joint tube 50 is welded at its outer face to one ends of four H steel beam joint members 62, 64, 66 and 68 so that the beam joint members are disposed in a horizontal plane with adjacent beam joint members forming a right angle. Webs 70 of the beam joint members 62, 64, 66 and 68 are jointed at their one ends via the wall of the joint tube 50 to corresponding outer ends of the webs 54, 56 and 58 of the load transfer assembly 52. The other end of each of the beam joint member 62, 64, 66 and 68 is welded to a beam not shown.

With such a construction, shearing force from the beams which are jointed to the joint members 62 and 64 is transferred via the beam joint members 62 and 64 and the wall of the joint tube 50 to the webs 54 of the load transfer assembly 52 and on the other hand shearing force from the beams which are jointed to the beam joint members 66 and 68 is transferred via the joint members 66 and 68 and the wall of the joint tube 50 to respective webs 58 and 56 of the load transfer assembly 52. Then, the shearing force is transferred by means of the bearing disc member 60 to the concrete core 36 as an axial force. Thus, the steel tube 42 is subjected to a rather smaller axial force from the beams than the concrete core 36. In the presence of the separating layer 34, the steel tube 42 and the joint tube 50 are axially movable relative to the concrete core 36 and hence when the concrete core 36 undergoes axial compression, the steel tube 42 follows the concrete core 36 with a much smaller degree of axial strain than the prior art steel tube bonded to its concrete core. Further, the axial compression of the steel tube 42 reduces its axial length by axially deforming the slits 48 of the slit portion 44, thus dissipating the axial stress in the steel tube 42 and the joint tube 50. In view of the of Mieses's yield conditions, strength of the steel tube 42 and the joint tube 50 against circumferential stress which develops in them due to a transverse strain of the concrete core 36 increases, thus enhancing confinement effect of the steel tube 42 which is provided to the concrete core 4. The column 40 insures higher compression strength than the column 30 of the preceding embodiment.

The load transfer assembly 52 may be provided to the steel tube 32 of the first embodiment. In place of the slit portion 44, a ring-shaped through slot may be formed in the steel tube 42 as means for absorbing an axial strain of the steel tube 42. That is, a ring gap may be provided between the ends of the two tube pieces 46 and 46 without welding the associated ends of the tube pieces 46 and 46 together. Alternatively, one or more ring grooves which extend full circumference of the steel tube 42 may be formed in it in place of the slits 48.

Figure 6:
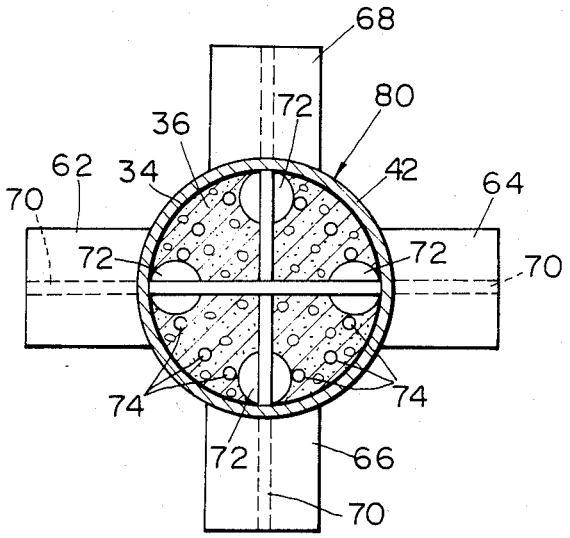
FIG. 6 is a view taken along the line VI—VI in FIG. 5.
Figure 5:
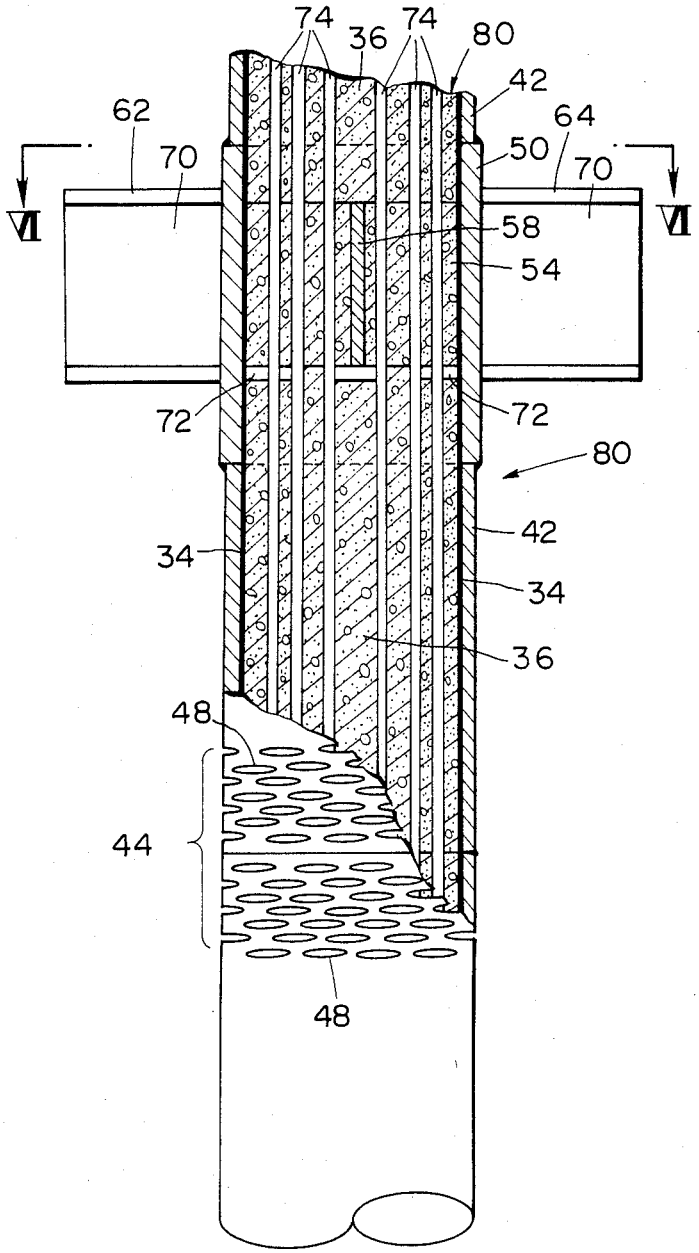
FIG. 5 is a front view, partly in section, of a modified form of the concrete filled steel tube column in FIG. 3.

A modified form of the embodiment in FIGS. 3 and 4 is illustrated in FIGS. 5 and 6, in which four bearing discs 72 are welded to lower edges of the webs 54, 56 and 58 of the load transfer assembly 52 to be disposed in a horizontal plane at 90° angular intervals as shown in FIG. 6. In this modification, a plurality of reinforcements 74 are axially disposed within the steel tube 42 and the joint tube 50 at angular intervals about the axis thereof. After the reinforcements 74 are disposed in such a manner, a concrete is charged into the joint tube 50 and the steel tube 42 in a conventional manner. A large proportion of shearing force from beam joint member 62, 64, 66 or 68 is transferred via the four bearing discs 72 to the concrete core 36. In the presence of the reinforcements 74, the column 80 has large strength as compared to the column 40 in FIGS. 3 and 4. Such reinforcements 74 may be disposed within the columns in FIGS. 1–4.

Figure 7:
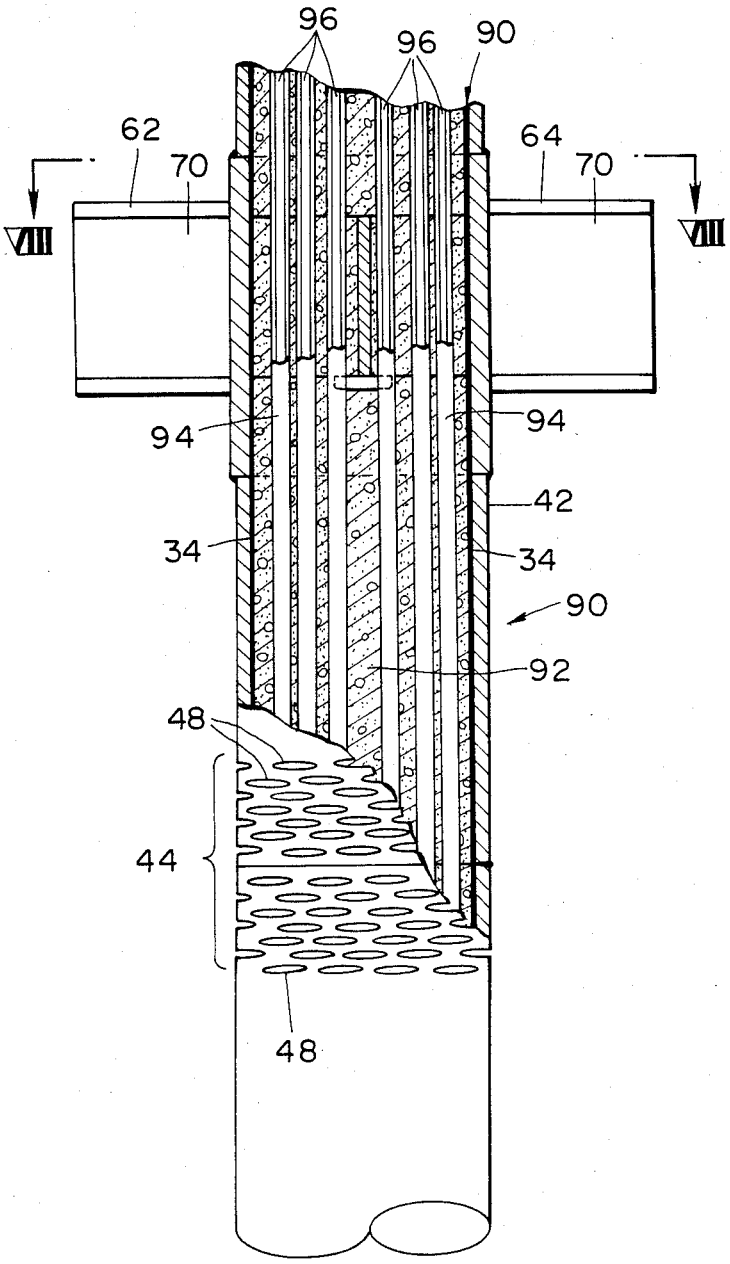
FIG. 7 is another modified form of the concrete filled steel tube column in FIG. 3.
Figure 8:
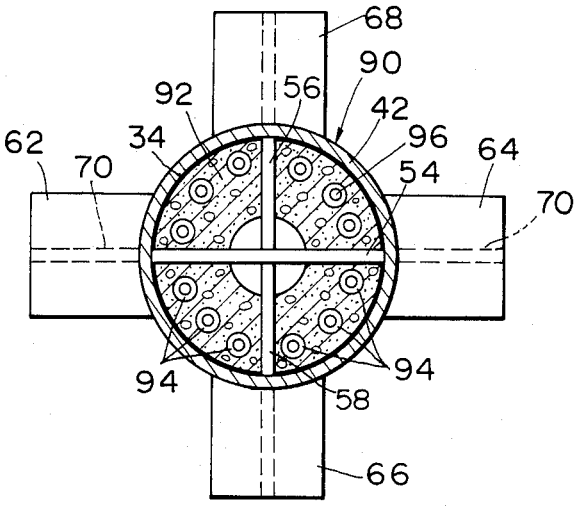
FIG. 8 is a view taken along the line VIII—VIII in FIG. 7.

A still modified form of the column 40 in FIGS. 3 and 4 is shown in FIGS. 7 and 8, in which a column 90 contains a prestressed concrete core 92. A plurality of, twelve in this modification, sheath pipes 94 are axially disposed within the steel tube 42 at substantially equal angular intervals about the axis thereof as shown in FIGS. 7 and 8. Each sheath pipe 94 has a PC steel rod 96 passed through it. After the concrete is set, a tension is conventionally applied to each PC steel rod 96. The sheath pipes 94 and PC rods 96 may be provided to the column 80 in FIGS. 5 and 6 instead of the reinforcements 74.

Figure 9:
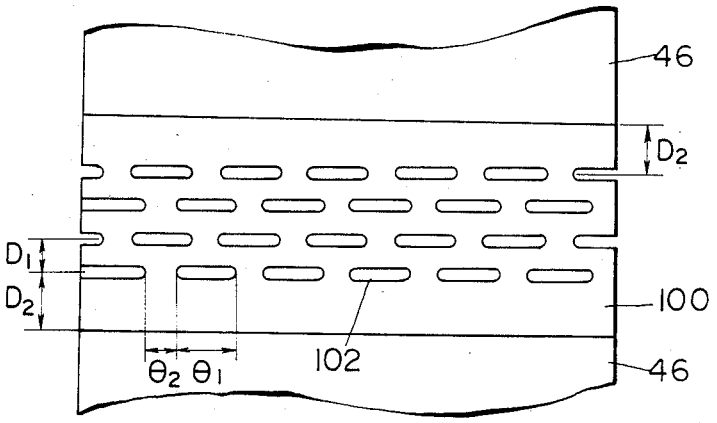
FIG. 9 is a partial view of a modified form of the concrete filled steel tube column in FIG. 3.

A modified form of the slit steel tube 42 is shown in FIG. 9, in which a sliced slit tube 100, having four rows of slits 102 formed through it, is coaxially welded at its opposite ends with a pair of tube pieces 46.

Figure 10:
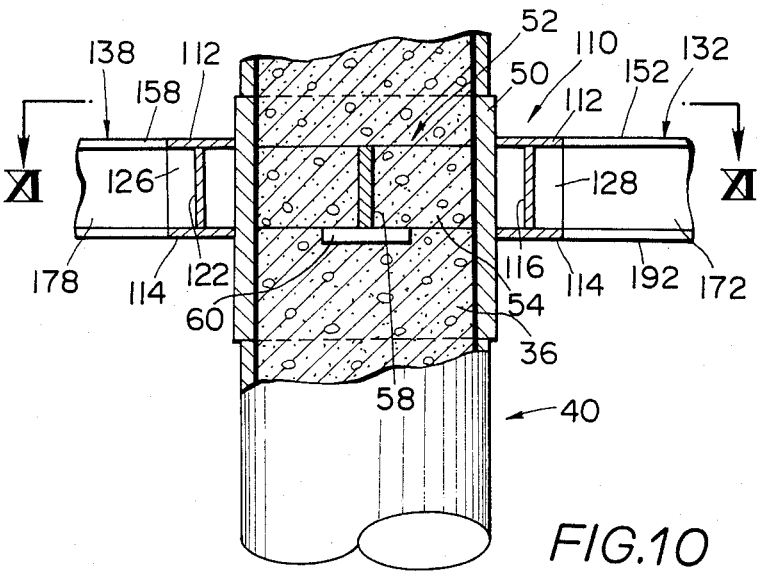
FIG. 10 is a front view, partly in section, of a still other modified form of the concrete filled steel tube column in FIG. 3.
Figure 11:
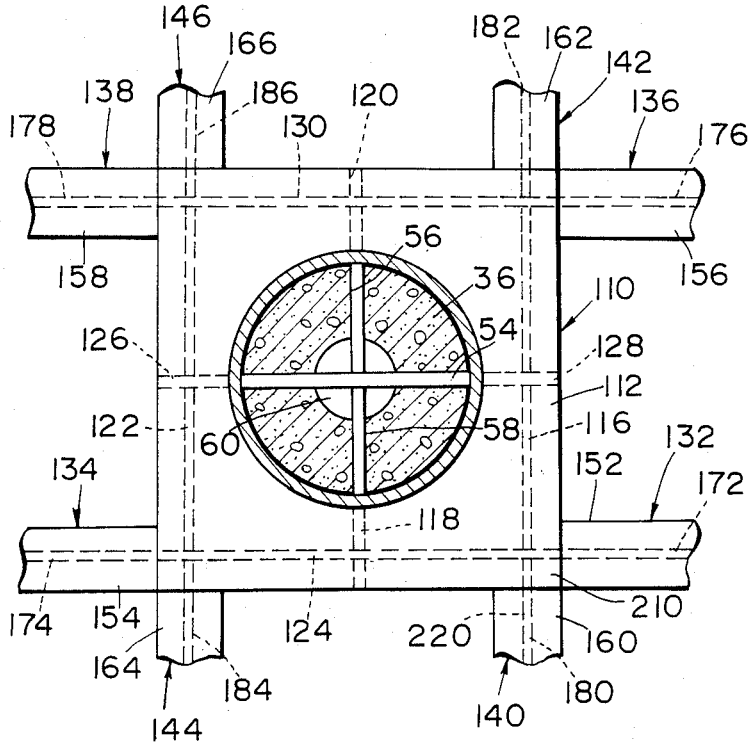
FIG. 11 is a view taken along the line XI—XI in FIG. 10.

FIGS. 10 and 11 illustrate another modified form of the concrete column in FIGS. 3 and 4, from which this modification is distinct in the joint structure of the joint tube 50 to beams. The joint tube 50 has a beam joint assembly welded around it. The joint assembly 110 includes a pair of parallel flanges 112 and 114 fitted around and welded to the joint tube 50. The flanges 112 and 114 are jointed by means of ribs 116–130. The ribs 116–130 and the outer wall of the joint tube 50 define four separate spaces. The inner ends of the ribs 118, 120, 126 and 128 are welded through the wall of the joint tube 50 to the outer ends of the webs 54, 56 and 58 of the load transfer assembly 52. Each corner of the joint assembly 110 is jointed to ends of two perpendicular H steel beams 132 and 140, 134 and 144, 136 and 142 or 138 and 146. More specifically, with respect to the beam 132, one end of its upper flange 152 is welded to the one edge of the upper flange 112 at one corner 210, one end of the web 172 to one end of the rib 124 and one end of the lower flange 192 to one edge of the lower flange 114 at the one corner 210. On the other hand, the beam 140 has an upper flange 160 welded at its one end to the other edge of the upper flange 112 at the one corner 210, a web 180 welded at its one end to one end of the web 116, and a lower flange 220 welded at its one end to the other edge of the lower flange 114 at the one corner 210. In the same manner, the other beams 134–138 and 142–146 are jointed to the other corners of the upper and lower flanges 112 and 114 of the flange assembly 110.

With such a construction, a shearing force exerted on the beams 132 and 134, mainly on the webs 172 and 174 thereof is transferred via ribs 124 to the web 118, from which it is transferred via the joint tube 50 and the web 58 to the bearing disc 60, which in turn transfers the force as an axial force to the concrete core 36. The beams 136 and 138 transfer a shearing force, which is exerted on them, via ribs 130 and 120, the joint tube 50 and the web 56 to the bearing disc 60. The beams 140 and 142 transfer a shearing force exerted on them via ribs 116 and 128, the joint tube 50 and the web 54 to the bearing disc 60. Lastly, a shearing force exerted on the beams 144 and 146 is transferred via the ribs 122 and 126, the joint tube 50 and the web 54 to the bearing disc 60.

In this modification, the beams 132–146 are jointed through the joint assembly 110 to the column 40 and hence this beam and column joint structure is longer in web length than the beam and column joint structure in the preceding embodiments. Thus, the beams 132–146 are capable of deflecting in a larger degree and hence this modified form has a more flexible column and beam joint structure than the preceding embodiments. This joint structure may be adopted in the embodiments in FIGS. 3–8.

Figure 12:
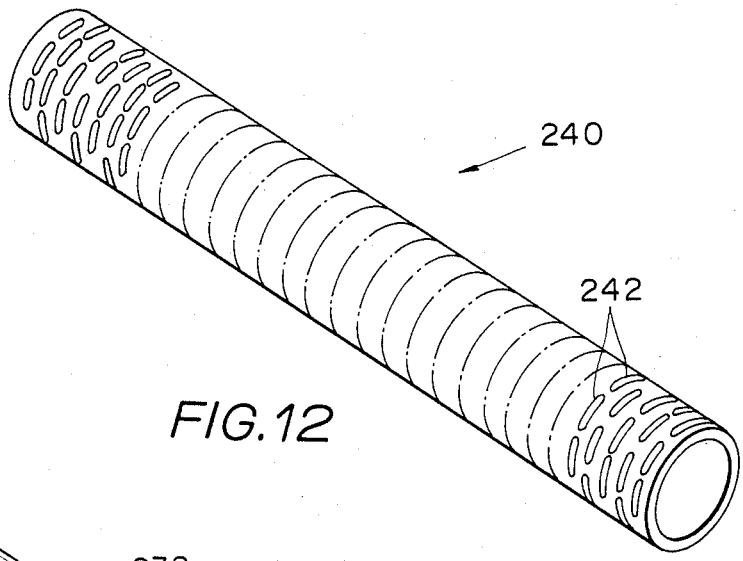
FIG. 12 is a perspective view of a slit tube.
Figure 13:
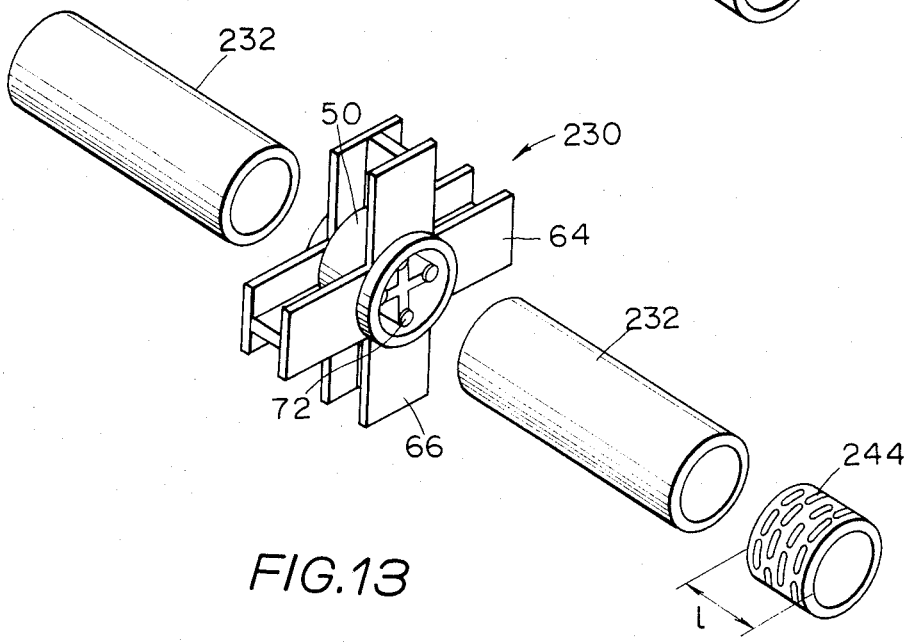
FIG. 13 is an exploded view of a steel tube used in a modified form of the concrete filled steel tube column in FIG. 3.
Figure 14:
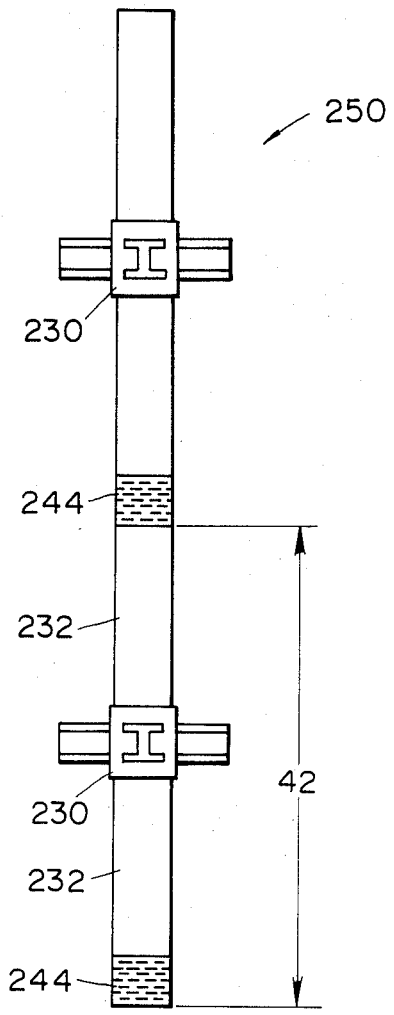
FIGS. 14 to 17 illustrate a process of constructing a building framework using the steel tube in FIG. 13.
Figure 15:
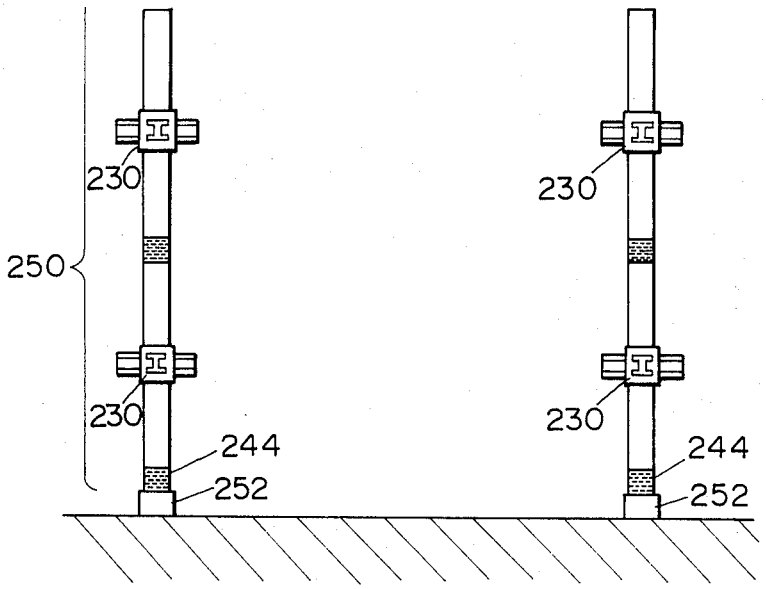

FIGS. 12–17 illustrate a process for fabricating a modified form of the column 40 in FIGS. 3 and 4. First of all, a joint tube assembly 230 as shown in FIGS. 5 and 6 is prepared. The joint tube 50 of the joint tube assembly 230 is welded at each of its opposite ends to a tube body 232. On the other hand, a slit steel tube 240 which has a large number of slits 242 formed through it over the whole area thereof is prepared as illustrated in FIG. 12. The slit steel tube 240 may be produced by centrifugal casting or by forming slits through a conventional steel tube with a water jet, a high speed cutter, gas torch, etc. The slit tube 240 thus prepared is sliced into many slit pieces 244 having a length of 1. One slit piece 244 is concentrically welded to the free end of one tube body 232 welded to the joint tube 50, the tube body 232 having a longer length than the slit piece 244. Thus, there is prepared a steel tube 42 with the joint assembly 230 as indicated in FIG. 14. A plurality of, two in this embodiment, steel tubes 42 are welded in series as illustrated in FIG. 14 to form a jointed tube unit 250. Thereafter, a separating layer is applied over the inner face of the jointed tube unit 250 so that the jointed tubes 232, 50 and 244 may not be bonded to a concrete core to be disposed within them. The separating layer is formed by applying a separating material such as a grease, paraffin wax, asphalt and a like material or depositing a plastic film on the inner face of the jointed tubes. This separating layer forming process may be carried out before a plurality of steel tubes are welded.

Figure 16:
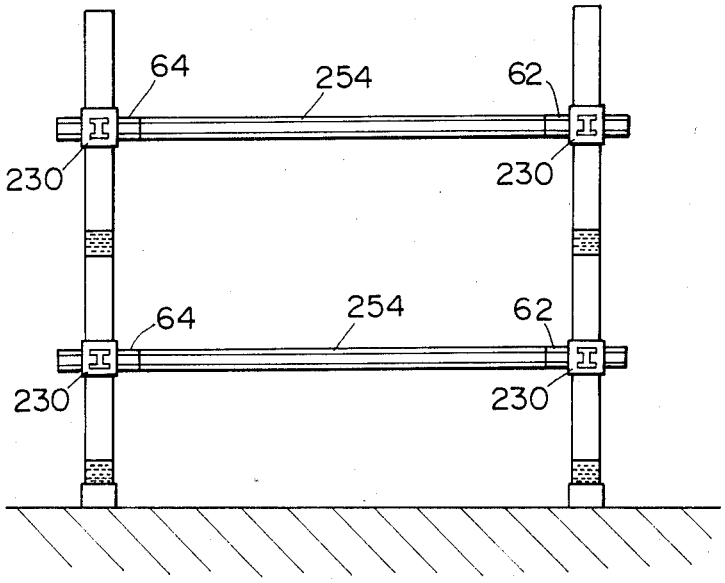
Figure 17:
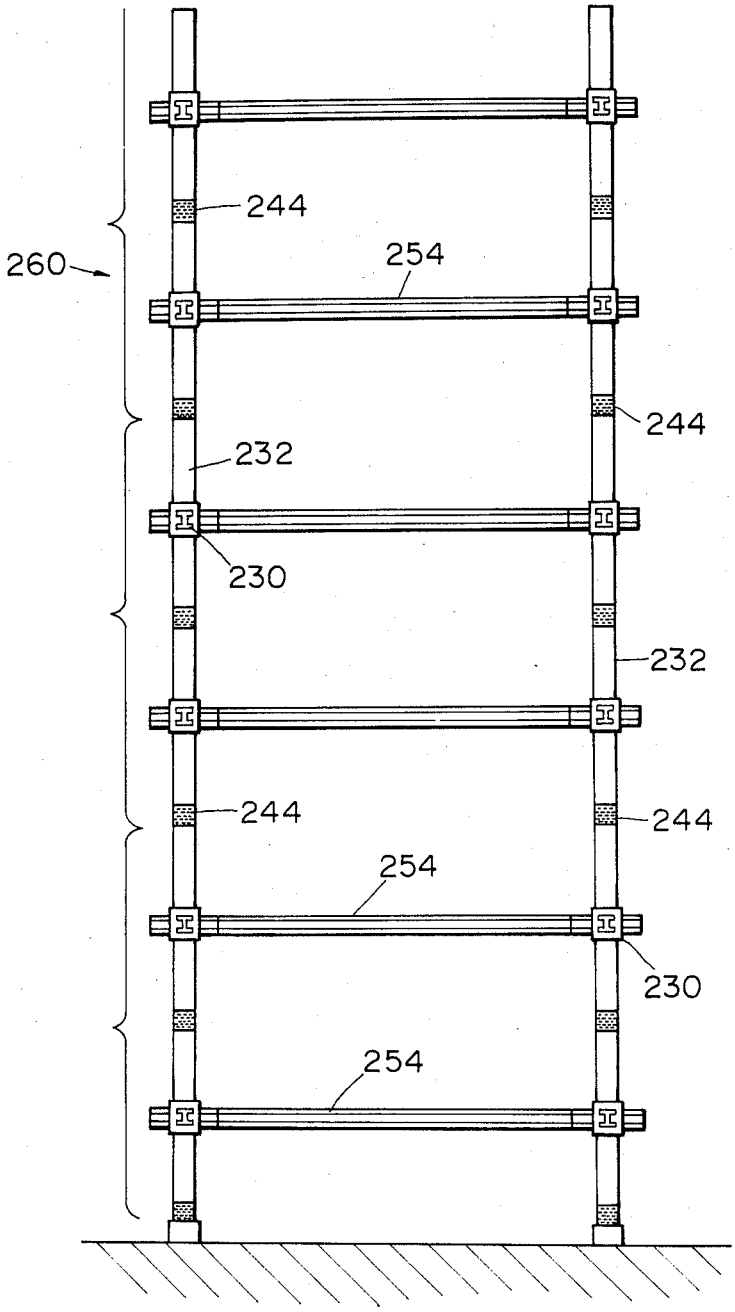

In constructing a building framework, a plurality of the joint tube units 250 above described are prepared. Joint tube units 250 for the first or ground floor are erected by means of a crane on bases 252, in which event a slit piece 244 welded to one end of each jointed tube unit 250 is placed on a corresponding base 252. Adjacent two tube units 250 erected are spanned with two beams 254 and 254 which are welded or jointed by bolts at their opposite ends to respective opposing beam joint members 62 and 64 of the corresponding joint assembly 230 of the tube units 250 as shown in FIG. 16. At this stage of the construction, reinforcements may be disposed as shown in FIGS. 5 and 6 if needed. Then, a concrete is charged into the tube unit 250 and cured. In filling with the concrete, the upper end portion of each tube unit 250 is left unfilled to form a space as shown by reference numeral 38 in FIG. 1 for jointing of subsequent tube unit 250. Then, tube units 250 for the next floor are welded at their slit parts 244 to the upper ends of corresponding tube units 250 already erected as shown in FIG. 17. By repeating the above-described procedures, a more than two story building framework 260 is constructed as illustrated.

In this construction process, each tube unit 250 has two steel tubes 42 each having joint assembly 230 but it may use the steel tube 42 in number of one or more than two. Before beams 254 are welded to the tube units 250, more than two tube units may be jointed in series.

Although in the preceding embodiments, slits are partially formed in steel tubes 42, slits may be formed to distribute in the overall face thereof as illustrated in FIG. 12. Before assembling, the steel tube 42 may be axially stretched to have a longer length. By doing so, the steel tube unit 250 is subjected to a less axial strain when the concrete core is compressed. In this case, before stretching, the steel tube 42 is provided with circumferential slits which are deformed into wider slits 242 when axially stretched.

EXAMPLE 1

A steel tube having a 114 mm outer diameter, a 6.0 mm thickness and a 340 mm length was prepared. Young's modulus $E_s$ of the steel tube was $2.1\times10^6$ Kg/cm$^2$ and yield point thereof was 2900 Kg/cm$^2$. An asphalt was spayed over the inner face of the steel tube to form a 100$\mu$ asphalt coating. A concrete which was prepared in composition as given in Table 1 was charged into the asphalt coated steel tube from the bottom to the top to form a test column. In Table 1, each component is given in Kg per 1 m$^3$ of the concrete prepared. A concrete test piece made of the concrete above and having a 100 mm diameter and a 200 mm height had cylinder strength of 602 Kg/cm$^2$, which is substantially equal to strength according to ACI (U.S.A.), and Young's modulus of $3.74\times10^5$ Kg/cm$^2$. The test column was cured for 4 weeks and then axial load-strain behavior of the test column was determined. In this test, the test column was vertically supported in a hydraulic test machine and static axial loads were applied by a hydraulic jack to only the top face of its concrete core. The results are given in FIG. 18 in which axial strain $\epsilon_{sz}$ and hoop strain $\epsilon_{s\Theta}$ of the steel tube are given in the solid lines and axial strain $\delta_c$ of the concrete core is given by the dot and chain line. It was noted that the ultimate axial load was 168 metric tons and the yield strength of the concrete core was 2056 Kg/cm$^2$.

COMPARATIVE TEST 1

A concrete having the same composition as in Example 1 was charged into another steel tube having the same dimensions and properties as the steel tube in Example 1. The same test was conducted on this test piece except that static axial loads were applied to the overall top end face thereof. The results are plotted in FIG. 19, from which it is clear that the ultimate axial load was 132 metric tons and the yield strength of the concrete core was 1616 Kg/cm$^2$.

TABLE 1

(Kg/m$^3$)

| | Example 1 | Comparative Test | Example 2 |
|---|---|---|---|
| Water | | 145 | 180 |
| Cement | | 580 | 423 |
| Sand | | 670 | 668 |
| Aggregate | | 893*1 | 1034*2 |
| Slump (cm) | | 20.0 | 16 |

*1 5–15 mm sand stone river gravel
*2 10–20 mm sand stone river gravel

EXAMPLE 2

A slit steel tube 2800 mm long which consisted of a slit steel tube piece and a pair of two steel tube members coaxially welded at their one ends to the opposite ends of the slit steel tube piece as shown in FIG. 9. The slit steel tube had a 100$\mu$ asphalt coating as in the Example 1. The dimensions of the slit steel tube piece and the two steel tube members are given in Table 2. Young's modulus $E_s$ of the steel tube was $2.1\times10^6$ Kg/cm$^2$ and yield point thereof was 3100 Kg/cm$^2$. The slit steel tube piece had nine rows of slits formed by a high speed cutting, each row including 4 slits having an equal angular spacing $\theta_2=15°$. Each slit had a 3 mm vertical width and extending in an angular range $\theta_1$ of 75°. The distance $D_1$ between centers of slits of adjacent rows was 10 mm and the distance $D_2$ between the centers of outermost rows and nearer edges was 20 mm. A concrete which was prepared in composition as given in Table 1 was charged into the asphalt coated steel tube from the bottom to the top to form another test column. A concrete test piece which was made of this concrete and which had a 100 mm diameter and a 200 mm height had a cylinder strength of 420 Kg/cm$^2$ and Young's modulus of $2.94\times10^5$ Kg/cm$^2$. The test column was cured for 4 weeks and then the steel tube column thus prepared was horizontally held at its opposite ends and a constant axial force of 102 metric tons was applied to its one end of the concrete core while the other end is held stationary. Under these conditions, static loads P were applied at positions, which were spaced $\frac{1}{4}$ of the steel tube length 2L from the opposite ends, in opposite vertical directions as shown in FIG. 20. A hysteresis loop obtained is plotted in FIG. 21, where the angle R is an angle of the axis of the steel tube with the horizontal plane in term of radian and the moment $M=P\cdot L/4$.

TABLE 2

(mm)

| | Slit tube piece | Steel tube members |
|---|---|---|
| Outer diameter | 216 | 216 |
| Length | 120 | 1340 |
| Thickness | 12 | 8.2 |

What is claimed is:

1. A structural filler filled steel tube column, comprising:

a steel tube having an inner face;

a core made from the structural filler disposed within the steel tube; and a separating layer, interposed between the inner face of the steel tube and the core, for separating the core from the inner face of the steel tube so that the steel tube is unbonded to the core;

the steel tube including a stress reducing portion including a plurality of narrow through openings formed in the stress reducing portion for reducing axial stresses which develop in the steel tube without reducing the ability of the steel tube to provide lateral confinement to the core.

2. A structural filler filled steel tube column according to claim 1, wherein said separating layer is made of a substance selected from the group consisting of an asphalt, grease, oil, paraffin wax, paper and plastic.

3. A structural filler filled steel tube column according to claim 1, wherein said narrow openings are arranged in plural rows circumferentially formed in the stress reducing portion at equal angular spacing, adjacent narrow openings of adjacent rows being staggard in position thereof in a zigzag manner.

4. A structural filler steel tube column according to claim 3, wherein the rows of narrow openings are formed so that the stress reducing portion is plastically deformed by reducing a vertical width of the narrow openings before the steel tube is subjected to local buckling when an excess axial load is applied to the steel tube column.

5. A structural filler steel tube column according to claim 4, wherein the axial width of axially aligned narrow openings is approximately equal to a maximum axial strain of said steel tube to be caused by an overturning moment of a building using the column.

6. A structural filler filled steel tube column according to claim 4, wherein the steel tube comprises a perforated steel piece defining the stress reducing portion, and a pair of steel tube pieces coaxially welded at their one ends to respective opposite ends of the perforated piece.

7. A structural filler filled steel tube column according to claim 5 or 6, wherein the narrow openings each comprises one of a slit, a slot and a like configuration.

8. A structural filler filled steel tube column according to claims 1, 3, 4 or 5, wherein the steel tube further includes means for transferring an axial load, applied to the steel tube, to the core.

9. A structure filler filled steel tube column according to claim 8, wherein the steel tube further includes jointing means for jointing beams thereto, the jointing means including a joint tube having a inner face, and wherein the load transfer means is mounted to the inner face of the joint tube for transferring an axial load exerted on the joint tube to the core.

10. A structural filler filled steel tube column according to claim 9, wherein said load transfer means comprises a cross-shaped web assembly including a pair of web members crossing each other and disposed parallel to an axis of the joint tube, the web members being jointed at opposite ends thereof to the inner face of the joint tube.

11. A structural filler filled steet tube column according to claim 10, wherein said load transfer means further comprises bearing means, jointed to said web assembly, for bearing the web assembly and for transferring the axial load from the web assembly to the core.

12. A structural filler filled steel tube column according to claim 11, wherein said bearing means comprises at least one bearing plate member jointed to said web assembly and located in a plane perpendicular to the axis of the joint tube.

13. A structural filler filled steel tube column according to claim 11, wherein said bearing means comprises a bearing disc member jointed to one of the opposite edges of said web assembly and coaxial with the joint tube.

14. A structural filler filled steel tube column according to claim 11, wherein said bearing means comprises four bearing plate members symmetrically disposed with respect to the axis of the joint tube.

15. A method of constructing a filed steel tube of the type including a steel tube, a core made from a structural filler disposed within the steel tube, and a separating layer interposed between an inner face of the stel tube and the core to separate the core from the inner face and to keep the core unbonded to the steel tube, the method comprising the steps of:

(a) preparing the steel tube;

(b) forming the separating layer on the inner face of the steel tube; and thereafter (c) charging said structural filler into the steel tube to form a core therewithin, whereby the steel tube is slidable relative to the core; and wherein the preparing step includes the steps of (d) forming a plurality of circumferential rows of slits through the steel tube for absorbing an axial strain which develops in the steel tube when the steel tube is subjected to an axial load, (e) coaxially joining a joint tube to the steel tube for jointing beam members to the joint tube, and (f) mounting a load transfer assembly within said joint tube for transferring a load from the beam members via the joint tube to the core when the beam members are jointed to the joint tube.

16. A method according to claim 15, further including the steps of:

(g) erecting the steel tube with the separating layer formed therein; and (h) joining the beam members to the joint tube; and wherein both steps (g) and (h) occur prior to the charging step.

17. A method according to claim 16, further comprising the step of (i) coaxially jointing another steel tube to the steel tube having said separating layer, whereby a building framework is constructed by repeating the above-mentioned steps (a) to (i).

18. A structural filler filled steel tube column, comprising:

a steel tube having an inner face;

a core made from the structural filler disposed within the steel tube; and a separating layer, interposed between the inner face of the steel tube and the core, for separating the core from the inner face of the steel tube so that the steel tube is unbonded to the core;

the steel tube including (i) a stress reducing portion including means for reducing axial stresses which develop in the steel tube without reducing the ability of the steel tube to provide lateral confinement to the core, (ii) means for transferring an axial load, applied to the steel tube, to the core, and (iii) jointing means for jointing beams to the steel tube, the jointing means including a joint tube having an inner face, wherein the load transfer means comprises a cross-shaped web assembly including a pair of web members crossing each other and disposed parallel to an axis of the joint tube, the web members being jointed at opposite ends thereof to the inner face of the joint tube for transferring an axial load exerted on the joint tube to the core.

19. A structural filler filled steel tube column according to claim 18, wherein said load transfer means further comprises bearing means, jointed to said web assembly, for bearing the web assembly and for transferring the axial load from the web assembly to the core.

20. A structural filler filled steel tube column according to claim 19, wherein said bearing means comprises at least one bearing plate member jointed to said web assembly and located in a plane perpendicular to the axis of the joint tube.

21. A structural filler filled steel tube column according to claim 19, wherein said bearing means comprises a bearing disc member jointed to one of the opposite edges of said web assembly and coaxial with the joint tube.

22. A structural filler filled steel tube column according to claim 19, wherein said bearing means comprises four bearing plate members symmetrically disposed with respect to the axis of the joint tube.

* * * * *

UNITED STATES PATENT AND TRADEMARK OFFICE

CERTIFICATE OF CORRECTION

PATENT NO. : 4,722,156

DATED : February 2, 1988

INVENTOR(S) : Takanori Sato

It is certified that error appears in the above-identified patent and that said Letters Patent is hereby corrected as shown below:

Column 8, line 35, Claim 4: "filler steel" should read as --filler filled steel--

Column 8, line 42, Claim 5: "filler steel" should read as --filler filled steel--

Column 9, line 6, Claim 11: "steet" should read as --steel--

Column 9, line 25, Claim 15: "filed" should read as --filled--

Column 9, line 28, Claim 15: "stel" should read as --steel--

Signed and Sealed this

Thirteenth Day of September, 1988

*Attest:*

*Attesting Officer*

DONALD J. QUIGG

*Commissioner of Patents and Trademarks*